US006459023B1

(12) United States Patent
Chandler

(10) Patent No.: US 6,459,023 B1
(45) Date of Patent: Oct. 1, 2002

(54) MOUNTING BOARD FOR GUITAR EFFECTS

(76) Inventor: John Chandler, 3508 Refuge Trail, Thompson Station, TN (US) 37179

( * ) Notice: Subject to any disclaimer, the term of this patent is extended or adjusted under 35 U.S.C. 154(b) by 97 days.

(21) Appl. No.: 09/656,680

(22) Filed: Sep. 7, 2000

Related U.S. Application Data

(60) Provisional application No. 60/152,569, filed on Sep. 7, 1999.

(51) Int. Cl.[7] ..... G10C 3/02
(52) U.S. Cl. ..... 84/177; 84/179; 84/180
(58) Field of Search ..... 84/177, 179, 180, 84/184, 185, 186.1, 187, 190, 192

(56) References Cited

U.S. PATENT DOCUMENTS 3,433,881 A 3/1969 Cotton
4,445,415 A 5/1984 Izquierdo
4,488,468 A 12/1984 Peterson et al.
5,166,467 A 11/1992 Brown
5,442,986 A * 8/1995 Cota ..... 84/267
5,452,951 A * 9/1995 Peller ..... 108/6
5,866,829 A * 2/1999 Pecoraro ..... 84/177

* cited by examiner

*Primary Examiner*—Robert E. Nappi
(74) *Attorney, Agent, or Firm*—Waddey & Patterson; David B. Pieper

(57) ABSTRACT

An effect support board including an effect mounting surface adapted to mount a guitar effect and including a cable connection opening adapted to allow the cable to pass from beneath the effect mounting surface for connection to the guitar effect on top of the effect mounting surface. The effect mounting surface supported by a frame.

13 Claims, 5 Drawing Sheets

MOUNTING BOARD FOR GUITAR EFFECTS

This application claims benefit of co-pending Provisional U.S. Patent Application Ser. No. 60/152,569 filed Sep. 7, 1999, entitled "Pedalboard."

BACKGROUND OF THE INVENTION

The present invention relates generally to the mounting of pedal controls positioned for foot operation. More particularly, this invention pertains to the mounting of guitar effects on a pedal board for heavy duty applications.

Several United States Patents have been directed towards the general area of art including the mounting of foot pedals. Generally, these pedals are for use with keyboards. The patents include: U.S. Pat. No. 3,433,881, issued to Cotton, on Mar. 18, 1969; U.S. Pat. No. 4,445,415, issued to Izquierdo, on May 1, 1984; U.S. Pat. No. 4,488,468, issued to Peterson, et al, on Dec. 18, 1984; U.S. Pat. No. 5,166,467, issued to Brown, on Nov. 24, 1992; U.S. Pat. No. 5,442,986, issued to Cota, on Aug. 22, 1995; U.S. Pat. No. 5,452,951, issued to Peller, on Sep. 26, 1995; and U.S. Pat. No. 5,866,829, issued to Pecoraro, on Feb. 2, 1999.

Of these patents, only one is directed towards the use of guitar pedal mounting board or rack. U.S. Pat. No. 5,866,829 issued to Pecoraro on Feb. 2, 1999 discloses a pedal rack. This invention discloses the use of a case with a lower member for mounting multiple pedal systems with a vertically pivotal component rack. This patent illustrates the problems associated with prior art for mounting guitar effects pedals as used in the industry.

Musicians playing electronically amplified guitars tend to use small, electronic, sound altering devices called "guitar sound effects" to change the natural sound of their instruments. These sound effect devices, commonly called effects pedals, rest on the floor when in use and are controlled by foot operation switches in order to leave the user's hands free to play the instrument.

Since the introduction of guitar effects in the late 1960's, the common practice of using several different effects in a simultaneous manner has presented a common problem. When these multiple effects pedals are used together, they must be interconnected by cables to the original source of the sound to be altered, and then connected to the amplification system. These devices and cables generally rest on the floor of the performance area or stage. This presents the risk of the devices moving out of place when stepped on or activated. Additional dangers are present because the scattered arrangement of these devices leads to them being kicked or tripped over, which can lead to the accidental disconnection of one or more of the devices. This is a common occurrence, especially on a dimly lit stage. Further problems may be encountered because of the risk of internal electronic damage to this equipment and the amplification system or guitar being played.

The prior art solution for this problem is to mount the guitar pedal effects on a wooden board to position the effects in place. The cables are then inserted into the adapters on the guitar effects and arranged between the pedals on the board. The wooden board may be placed in a carrying case and the cables covered by foam so that the cables are not exposed. This restricts the ability to change out or one effect for another or add an additional effect because the foam must be removed to uncover the cable connections, the effect removed from the board, the cables repositioned for the new effect, the new effect positioned on the board, the cables rerouted, and the foam re-cut or replaced for the new effect.

What is needed, then, is an improved pedal effects board which allows easy positioning and changing of the individual guitar effects while providing a confined and secure area for cable routing and placement.

SUMMARY OF THE INVENTION

The effect support board of the present invention provides an optimum solution to the problems detailed in the prior art. The present invention provides to an effect support board for mounting a guitar effect above an area. A guitar effect may include a bottom surface and an adapter which allows for connection to a cable. The effect support board includes an effect mounting surface which is adapted to support the bottom surface of the guitar effect. This effect mounting surface includes a cable connection opening which is adapted to allow the cable to pass from the adapter on the guitar effect through the effect mounting surface into a cable routing and storage area which allows for the cable to be kept contained and out of the way during use of the effect pedals. This effect mounting surface is mounted on a frame which is adapted to support the effect mounting surface and take the rigors and impact associated with travel, playing, set-up, and teardown of the musical systems.

The present invention also teaches the method for constructing an effect support board, which is adapted to support a guitar effect. This method includes providing at least two end members and at least two cross members with each cross member having an upper surface and rigidly connecting the end members and cross members such that an upper surface of the cross members form an effect mounting surface and define a cable connection opening which passes through the effect mounting surface.

A preferred embodiment of the present invention teaches an effect support board for mounting a guitar effect above an area. This embodiment includes a support structure and at least two top surface elements connected to the support structure. The top surface elements include leg extensions which project from the support structure so that the top surface elements define edges of a first cable connection opening.

Further improvements include a frame support base for inclining the effect mounting surface and the addition of a frictional element to allow for repositioning and removal or replacement of an effect on the effect mounting surface.

DESCRIPTION OF THE PREFERRED EMBODIMENTS

Figure 2:
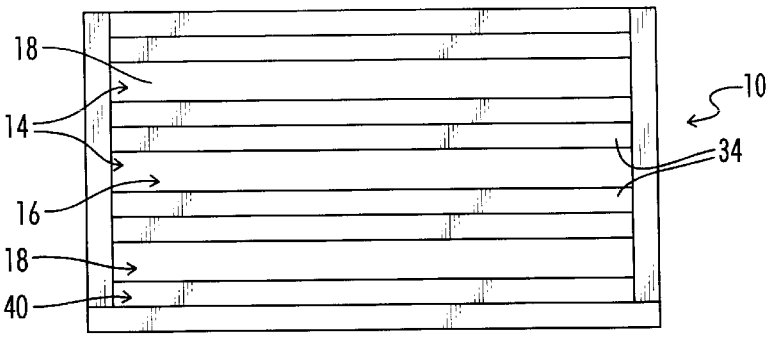
FIG. 2 is a bottom view of the effects mounting board.
Figure 3:
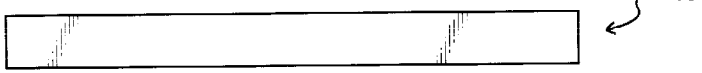
FIG. 3 is a back view of the effects mounting board.
Figure 4:
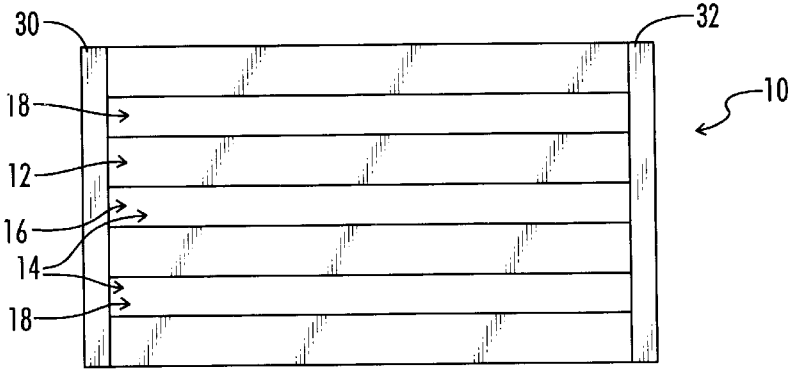
FIG. 4 is a top view of the effects mounting board.
Figure 5:
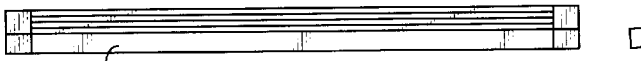
FIG. 5 is a front view of the effects mounting board.
Figure 6:
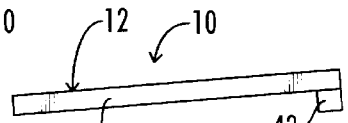
FIG. 6 is a right side view of the effects mounting board.
Figure 1:
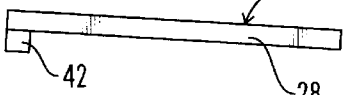
FIG. 1 is a left side view of the effects mounting board.

As shown in FIGS. 1 through 14 of the drawings, an effect support board is shown which includes as major components an effect mounting surface 12 a friction surface 20 a frame or support structure 28 and a frame base 42. This effect support board is designed to support a guitar effect 46 including a side 48 and end 50 a bottom surface 52 with an adapter 54 for connection to a cable 56. The effect mounting surface 12 is designed to mount the guitar effect 46 and provide a cable connection opening 14 to allow for the cable 56 to pass beneath the effect mounting surface 12 for connection to the guitar effect 46 mounted on top of the effect mounting surface 12. The effect mounting surface 12 is supported by the frame or support structure 28.

Figure 12:
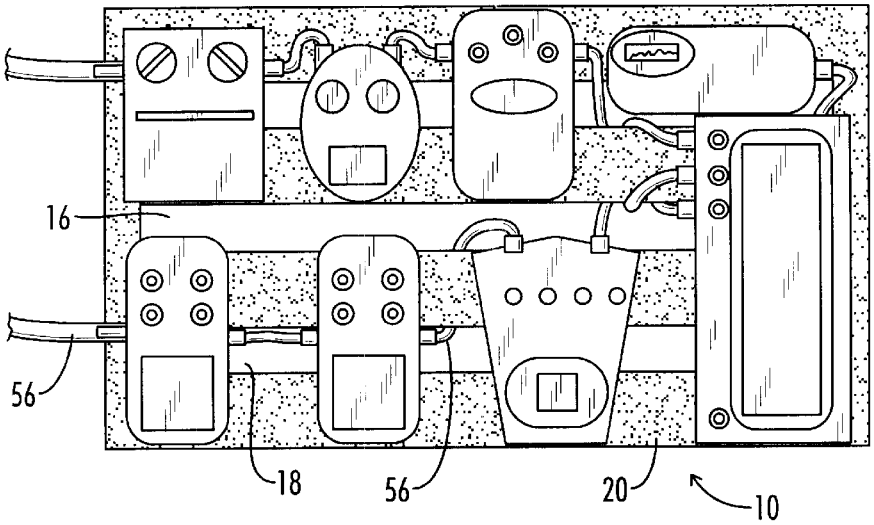
FIG. 12 is a top view of the effects mounting board showing installed effects.
Figure 13:
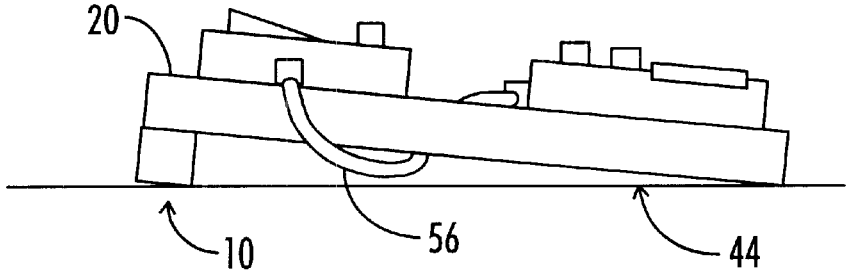
FIG. 13 is a side view of the effects mounting board showing installed effects.

The effect mounting surface 12 should be of sufficient structural strength in order to support and maintain the position of the guitar effects 46 during use. Thus, the effect mounting surface 12 should provide sufficient support for the guitar effect 46 to allow for a human being to foot operate the guitar effects 46. The effect mounting surface 12 includes cable connection openings 14 which may be defined as a side connection opening 18 or an end connection 16. As shown in FIG. 12 of the drawings the side connection openings 18 allow for the connection of cables 56 to the adapters 54 located on the side 48 of the guitar effect 46. Thus, a side connection opening 18 is placed approximately midline of the guitar effect 46 mounting area on the effect mounting surface 12. Also shown in FIGS. 12 and 13 are the locations of the end connection opening 16 which allow for connections of cables 56 to an adapter 54 located on the end 50 of the guitar effect 46. FIGS. 12 and 13 illustrate the placement of side connection openings 18 and end connection openings 16 for the double row configuration of the embodiment shown.

Figure 14:
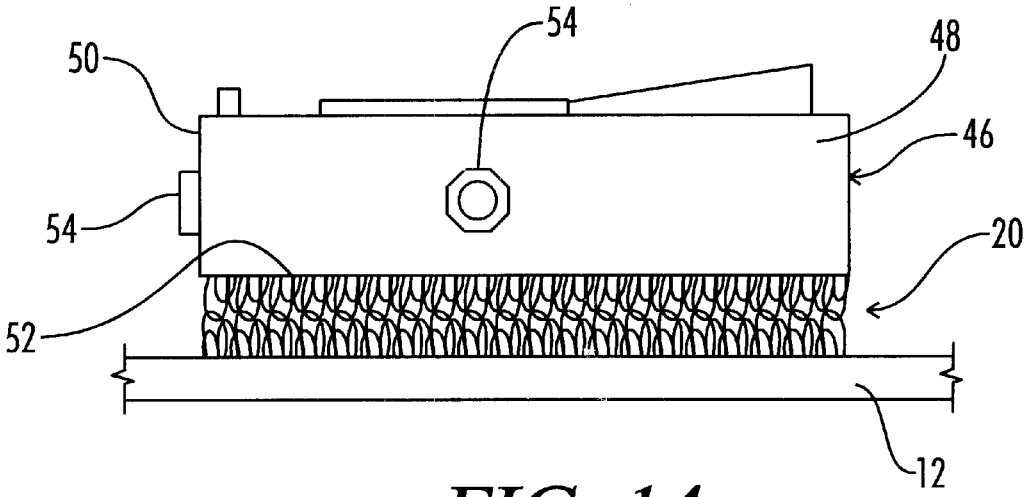
FIG. 14 is a side view of a guitar effect mounted on the frictional element and connected to the effects mounting surface.

As shown in FIG. 14 of the drawings, a friction surface 20 is connected to the effect mounting surface 12 and the bottom surface 52 of the guitar effect 46 to allow for support for the guitar effect 46 on the effect mounting surface 12. This friction surface 20 may be a hook and loop connection system 22 such as commonly sold under a product named Velcro™. The hook and loop connection system 22 may include a first side 24 and a second side 26 which alternatively include the hook side and the loop side of the hook and loop connection system 22. Obviously, the hook side and loop side of the equation can be changed back and forth between the first side 24 and the second side 26. The important characteristics for the friction surface 20 are that it maintains the guitar effect 46 in position on the effect mounting surface 12. Additional positional support may be supplied by tightly interweaving the cable 56 within the cable connection openings 14 and around the frame or support structure 28 to tightly hold the guitar effect 46.

Figure 7:
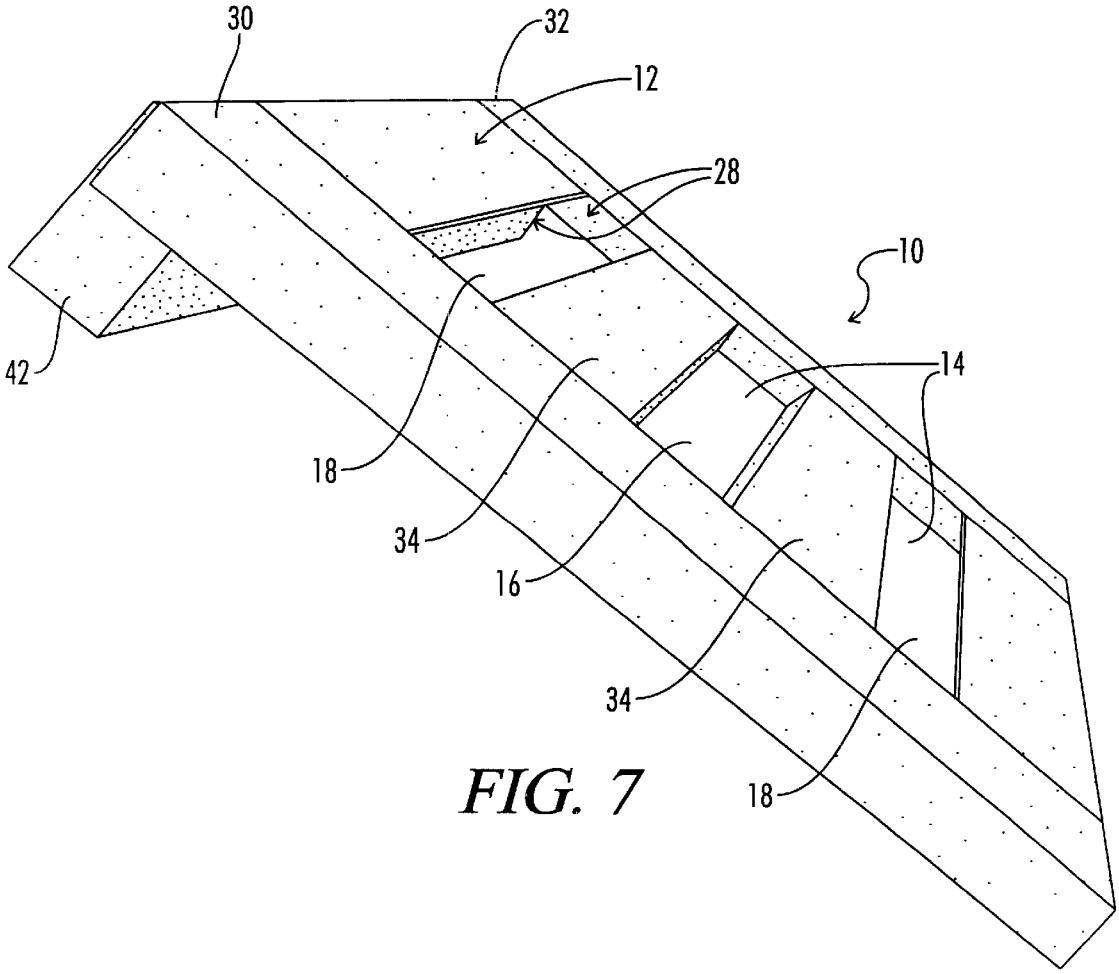
FIG. 7 is a top left isometric view of the effects mounting board.
Figure 8:
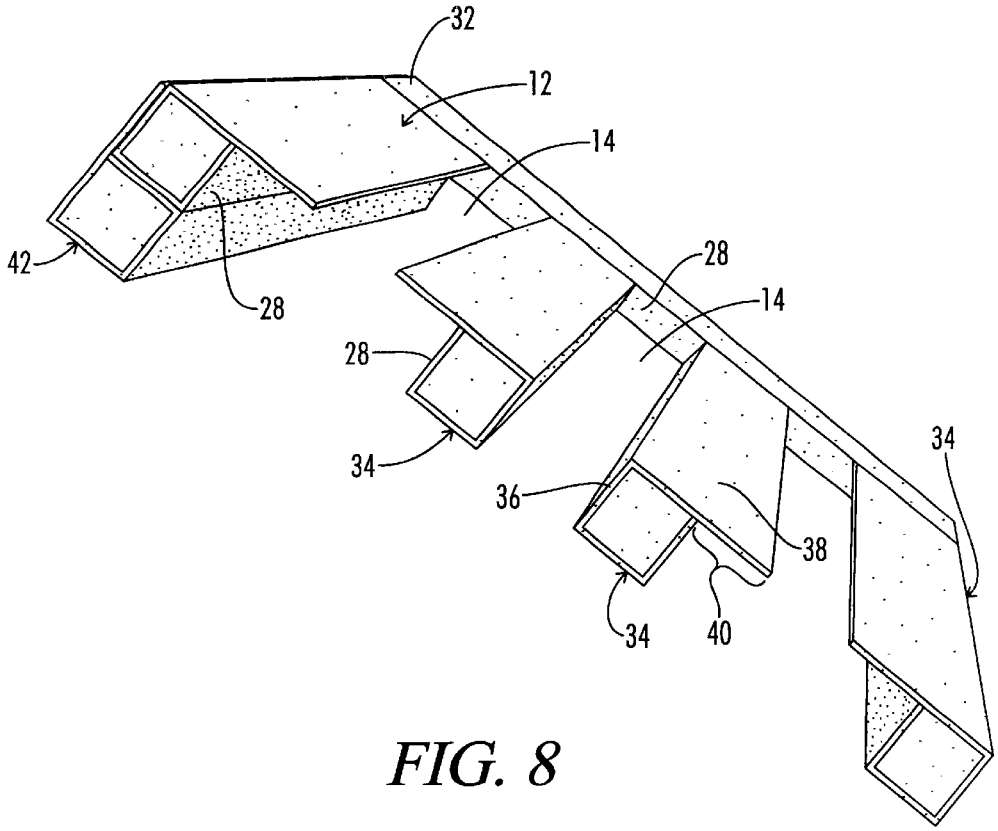
FIG. 8 is a top left isometric view of the effects mounting board as partially constructed.
Figure 9:
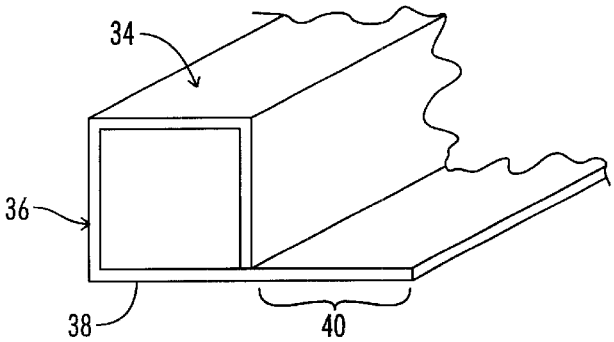
FIG. 9 is an isometric view of the b-shaped cross member and frame support base.
Figure 10:
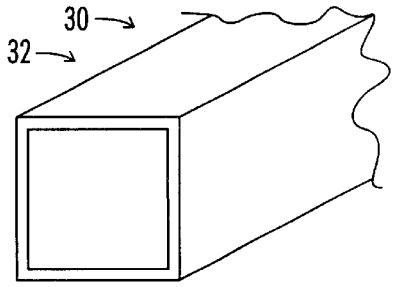
FIG. 10 is an isometric view of the square shaped end member.
Figure 11:
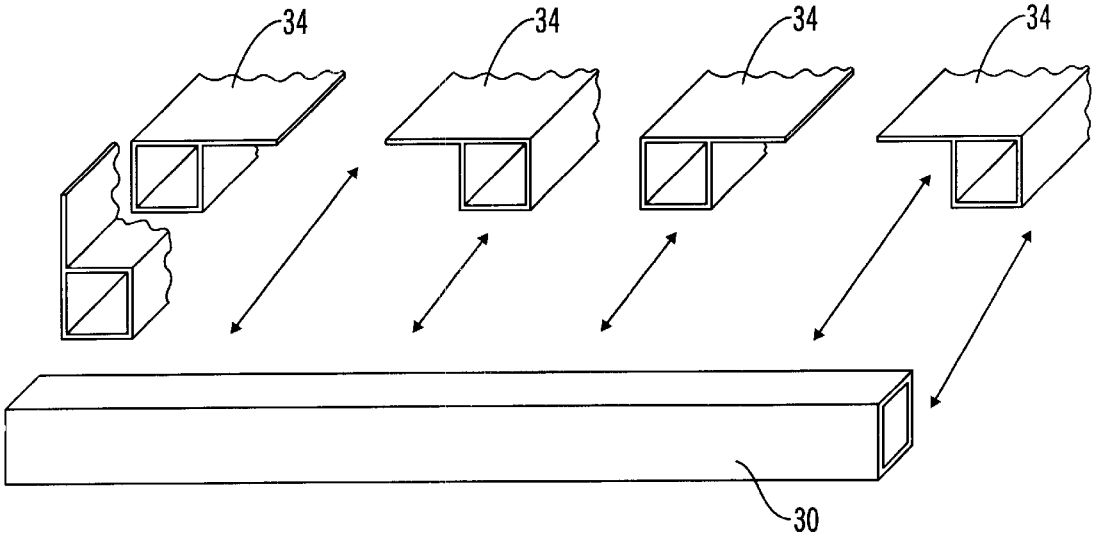
FIG. 11 is a top isometric view of the connection of cross members and end members for the effects mounting board.

FIGS. 7 through 11 show the method and construction of the effect support board 10. The effect support board 10 is constructed on a frame or support structure 28 which supports the effect mounting surface 12. As shown in FIG. 7, the frame or support structure 28 includes a first end member 30 and a second end member 32 which are connected by cross members 34. The cross members 34 are shown in FIG. 9 to include a deflection support section 36 of the frame 28 with a top surface element 38. The top surface element 38 20 includes a leg extension 40 which projects from the deflection support section 36. These leg extensions 40 may be pointed at a second leg extension 40 of a separate cross member 34 to form the effect mounting surface 12 while reducing the amount of material required. The small b shape construction of the cross member 34 allows for a single sheet of material to be bent to form the cross member 34 to keep the material cost low and the construction cost minimal. The exposed ends of the cross members 34, frame base 42, and end members 30, 32 are to be welded closed. This same small b structure may also be utilized as the frame base 42. As shown in FIGS. 7 through 11 of the drawings, the frame base 42 is connected to one of the outside cross members 34 to raise one end of the effect support board 10 to allow for an inclination of the effect mounting surface. By inclining the effect mounting surface 12 the guitar effects 46 may be presented in multiple rows and still be accessed easily by the feet of the guitar player. This inclination of the effect support board 10 helps to compensate for the arc of a swinging leg of a human. The preferred method of connecting is welding the members together although alternatives such as mechanical connections (screws, bolts, rivets, etc. . . . ) or adhesives may also be used. The pedal board is constructed by joining together the specifically cut lengths of square and b shaped aluminum tubing. The components are welded together at specific points to create the shape and form of the device as detailed in the drawings included in this application. The welds are to be primarily on the bottom side so as not to be seen from the top.

FIG. 13 of the drawing shows the method for mounting the guitar effect 46 on top of the effect mounting surface 12 on the effect support board 10. FIG. 13 also illustrates how the frame base 42 lifts one end of the frame or support structure 28 above the area 44 to provide spacing for the cables 56 to be run underneath the frame or support structure 28. The space defined by the frame base 42, the frame or support structure 28 and the top surface of the area 44 provide a concealed and protected area for running the cables 56 to keep them contained in a protective environment while the guitar effects 46 are being used on the effect support board 10.

FIG. 14 of the drawing shows the guitar effect 46 with the side 48 and end 50 for supporting the adapter 54. A guitar effect includes a bottom surface 52 on which the guitar effects 46 rests. FIGS. 12 and 13 illustrate how the cable 56 is connected to the adapter 54 to allow for the guitar effect 46 to be interconnected into the guitar or amplification system. These adapters 54 and cables 56 standardly use a phono type plug or circular power plug although any type of adapter and cable connection may be utilized.

Insert 1

The exterior dimensions of the completed pedal board or train 10 in a two row configuration are 12½ inches long and 22 inches wide. With a 1½ inch gap width for the cable connection opening 14. The height of the frame 28 and frame support base 42 is approximately 2 inches. The b shape cross members 34 are aluminum 1 inch square tube with rounded corners and a 1 inch leg extension 40 and are approximately 20 inches long. The end members 30, 32 are aluminum 1 inch square tubing with rounded corners of approximately 12½ inches length. The frame support base 42 is an aluminum 1 inch square tube with rounded corners with a 1 inch leg extension of approximately 22 inches length. As noted in the drawings the direction of the tubing may be alternated such that the legs will face towards each other and face away from each other in order to form the necessary cable connection openings 14.

Wall thickness of the device 10 is approximately 0.075 and the necessary tubing is produced by Southern Metal Companies, Inc. dye number 2680, and number 624. All these components are made of an alloy and temper number 6063. In general, the Velcro™ brand fastening system includes an adhesive back for connection to the back support surface and the bottom of the guitar effect itself.

This invention provides an optimum solution to the above detailed problem. When mounting the effects 46 on the pedal board 10 by use of the Velcro™ brand fastening system as a frictional surface 20, the user can safely and securely organize, operate and transport any number of effects pedals 46 as a single multi-functional unit. Effects pedals 46 may be added, subtracted or mounted indefinitely. Using the pedal board 10 in this manner will greatly reduce set up and tear down time. The arrangement of the effects pedals 46 and the pedal boards 10 can be reconfigured at any time by the user. Once mounted, the effects pedals 46 cannot move out of place or be disconnected, even under the most extreme conditions or circumstances that can be considered normal use. Connecting cables 56 may be routed under the pedal board 10 by passing them through the open slots 14 of the unit. Any excess cable 56 may be kept under the unit 10 in the space created by the elevated pitch of the pedal board 10. This feature further reduces the risk of any accidental disconnection.

Thus, although there have been described particular embodiments of the present invention of a new and useful Mounting Board for Guitar Effects, it is not intended that such references be construed as limitations upon the scope of this invention except as set forth in the following claims.

What is claimed is:

1. An effect support board for mounting a guitar effect above an area, the guitar effect including a bottom surface and an adapter for connection to a cable, the adapter located on an end of the guitar effect, the effect support board comprising:

an effect mounting surface adapted to mount a guitar effect, the effect mounting surface defining a cable connection opening adapted to allow the cable to pass from beneath the effect mounting surface for connection to the guitar effect on top of the effect mounting surface, the cable connection opening positioned as an end connection opening adapted to allow for direct connection of the cable to the adapter on the end of the guitar effect; and a frame coupled to the effect mounting surface and adapted to support the effect mounting surface.

2. An effect support board for mounting a guitar effect above an area, the guitar effect including a bottom surface and an adapter for connection to a cable, the adapter located on a side of the guitar effect, the effect support board comprising:

an effect mounting surface adapted to mount a guitar effect, the effect mounting surface defining a cable connection opening adapted to allow the cable to pass from beneath the effect mounting surface for connection to the guitar effect on top of the effect mounting surface, the cable connection opening positioned as a side connection opening adapted to allow for direct connection of the cable to the adapter on the side of the guitar effect; and a frame coupled to the effect mounting surface and adapted to support the effect mounting surface.

3. An effect support board for mounting a guitar effect above an area, the guitar effect including a bottom surface and an adapter for connection to a cable, the effect support board comprising:

an effect mounting surface adapted to mount a guitar effect, the effect mounting surface defining a cable connection opening adapted to allow the cable to pass from beneath the effect mounting surface for connection to the guitar effect on top of the effect mounting surface, the effect mounting surface including a friction surface adapted to engage the bottom surface of the guitar effect to maintain the positioning of the guitar effect on the friction surface; and a frame coupled to the effect mounting surface and adapted to support the effect mounting surface.

4. The effect support board of claim 3, friction surface including a hook and loop connection system with a first side and a second side, the first fixably positioned in relation to the frame and the second side fixably attached to the bottom surface of the guitar effect such that the guitar effect may be changeably positioned on the effect support board.

5. The effect support board of claim 2, further comprising:

a frame base adapted to support the frame above the surface to allow the cables to pass beneath the frame.

6. The effect support board of claim 2, further comprising:

a frame base adapted to support the frame at an inclined angle.

7. A method of constructing an effect support board adapted to support a guitar effect with a bottom surface and an adapter for connection to a cable, the method comprising:

providing at least two end members and at least two cross members, each cross member including an upper surface;

rigidly connecting the end members and cross members such that the upper surface of the cross members form an effects mounting surface and define a cable connection opening in the effects mounting surface; and fixably positioning a friction increasing element on the effects mounting surface for engaging the bottom surface of the guitar effect.

8. The method of constructing an effect support board of claim 7, further comprising:

inclining the effects mounting surface.

9. An effect support board for mounting a guitar effect above an area, the guitar effect including a bottom surface and an adapter for connection to a cable, the effect support board comprising:

a support structure;

at least two top surface elements connected to the support structure, the top surface elements including leg extensions projecting from the rigid support structure such that the top surface elements define edges of a first cable connection opening;

a third top surface element connected to the rigid support structure and including a third leg extension; and a forth top surface element connected to the rigid support structure and including a forth leg extension, the third top surface element and fourth top surface element defining edges of a second cable connection opening, wherein the top surface elements are aligned to form at least two rows of guitar effects.

10. The effect support board of claim 9, the second top surface element and third top surface element defining a third cable connection opening.

11. The effect support board of claim 10, the first connection opening positioned to allow for adapters positioned on the side of the first row of guitar effects, the second connection opening positioned to allow for adapters positioned on the side of the second row of guitar effects, and the third connection opening positioned to allow for adapters positioned on the ends of the first and second row of guitar effects.

12. An effect support board for mounting a guitar effect above an area, the guitar effect including a bottom surface and an adapter for connection to a cable, the effect support board comprising:

a support structure;

at least two top surface elements connected to the support structure, the top surface elements including leg extensions projecting from the rigid support structure such that the top surface elements define edges of a first cable connection opening; and a friction surface adapted to engage the bottom surface of the guitar effect to maintain the positioning of the guitar effect on the friction surface.

13. An effect support board for mounting a guitar effect above an area, the guitar effect including a bottom surface and an adapter for connection to a cable, the effect support board comprising:

a support structure;

at least two top surface elements connected to the support structure, the top surface elements including leg extensions projecting from the rigid support structure such that the top surface elements define edges of a first cable connection opening; and a frame base adapted to support the support structure above the surface to allow the cables to pass beneath the frame.

* * * * *